US006079788A

United States Patent [19]

Boucherie

[11] Patent Number: 6,079,788

[45] Date of Patent: Jun. 27, 2000

[54] DEVICE FOR REMOVING INDIVIDUAL FIBER TUFTS FROM UP TO THREE FIBER BINS OF A BRUSH MAKING MACHINE

[75] Inventor: Bart Gerard Boucherie, Izegem, Belgium

[73] Assignee: G. B. Boucherie N.V., Belgium

[21] Appl. No.: 09/135,485

[22] Filed: Aug. 18, 1998

[30] Foreign Application Priority Data

Aug. 22, 1997 [DE] Germany ..... 297 15 117 U

[51] Int. Cl.[7] ..... A46D 1/08

[52] U.S. Cl. ..... 300/7

[58] Field of Search ..... 300/1–11, 18, 300/19, 21

[56] References Cited

U.S. PATENT DOCUMENTS

| | | | |
|---|---|---|---|
| 1,888,351 | 11/1932 | Lipps | 300/7 |
| 2,607,629 | 8/1952 | Le Febvre | 300/7 |
| 3,215,472 | 11/1965 | Zahoransky | 300/7 |
| 4,733,917 | 3/1988 | Boucherie | 300/7 |
| 4,968,102 | 11/1990 | Boucherie | 300/7 |

FOREIGN PATENT DOCUMENTS

| | | | |
|---|---|---|---|
| 0 131 972 | 1/1985 | European Pat. Off. . | |
| 0 206 385 A2 | 12/1986 | European Pat. Off. . | |
| 346965 | 12/1989 | European Pat. Off. | 300/19 |
| 0 206 385 B1 | 5/1990 | European Pat. Off. . | |
| 1028969 | 4/1958 | Germany . | |
| 2128774 | 10/1972 | Germany . | |
| 29 11 668 | 9/1980 | Germany . | |
| 3 151 730 | 7/1983 | Germany . | |
| 4040297 | 6/1992 | Germany . | |
| 196 03 392 | 8/1997 | Germany . | |

*Primary Examiner*—Mark Spisich

*Attorney, Agent, or Firm*—Sixbey, Friedman, Leedom & Ferguson, PC; Stuart J. Friedman

[57] ABSTRACT

A device for removing individual fiber tufts from a plurality of fiber bins of a brush making machine comprises a tuft remover, a counterpart matching the tuft remover and a movable slide arranged between the counterpart and the fiber bins. The slide has a plurality of through-passages each of which is associated with one of the fiber bins. The outer passages of the slide are inclined at an angle to the central passage. Between the central fiber bin and each of the outer fiber bins an associated ram is arranged. Each ram has an end face which faces the slide and either bears on one side surface area of the slide or applies pressure to the opposite end of one of the outer through-passages, depending on the respective position of the slide. The device allows the tuft remover to selectively pick up tufts of three different types of fiber.

9 Claims, 3 Drawing Sheets

DEVICE FOR REMOVING INDIVIDUAL FIBER TUFTS FROM UP TO THREE FIBER BINS OF A BRUSH MAKING MACHINE

BACKGROUND OF THE INVENTION

The present invention relates to a device for removing individual fiber tufts from several fiber bins of a brush making machine.

In the manufacture of brushes which have a bristle array composed of different kinds of fibers or bristles, shiftable or rotatable fiber bins may be used which are positioned alternatingly in front of the tuft remover. In this way it is possible in principle to use any number of fiber bins having correspondingly many different kinds of bristles or fibers, especially bristles or fibers differing in color. During the stuffing action and between the individual working cycles the fiber bins are changed over (e.g. rotated or shifted) in such a manner that the particular bristle passage from which the bristles are to be picked is positioned by its outlet end at the removal point for the tuft removers.

This change-over needs to occur all the more quickly, the faster the stuffing speed of the brush making machine, the mass inertia of the fiber bins playing an important role in this respect, and in modern brush making machines cycling at high speed it is a problem to change over the relatively heavy fiber bins quickly enough.

This is why a device for removing individual tufts of fibers from two fiber bins of a brush making machine has already been defined as described in EP 0 206 385 B1. This device comprises between the tuft remover and he two fiber bins a slide which is shiftable translationally and features a through-passage assigned to each fiber bin. Depending on the position of the slide the one or the other through-passage is positioned opposite the tuft remover. As compared to the fiber bins the slide has a much smaller mass inertia and can thus be moved faster. However, it is not possible for principle reasons to use more than two fiber bins since separation between the different kinds of fibers would not be ensured.

SUMMARY OF THE INVENTION

The invention provides a device for removing individual fiber tufts from more than just two fiber bins of a brush making machine. In ways and means known per se this device comprises a tuft remover, a matching counterpart and a movable slide arranged between the counterpart and the fiber bins. In the case of a device having e.g. three fiber bins, the slide comprises three through-passages, each of which is assigned to one of the fiber bins. The two outer passages of the slide are inclined at an angle to the central passage. Between the central fiber bin and each of the outer fiber bins a ram is arranged, the end face of which facing the slide is either supported by one side surface area of the slide or applies pressure to the opposite end of one of the through-passages, depending on the position of the slide. Due to the outer passages being inclined at an angle, the ends thereof are mutually offset in the direction of movement of the slide. The degree of this offset corresponds preferably to the width of the associated ram. In movement of the slide between three positions, in each of which it positions one of the three through-passages opposite the tuft remover, no clashing occurs between fiber bins and non-assigned through-passages so that the fibers remain radically separated.

BRIEF DESCRIPTION OF THE DRAWINGS

Further features and advantages of the invention will be appreciated from the following description of several embodiments and from the drawings to which reference is made and in which.

DETAILED DESCRIPTION OF THE INVENTION

Figure 1:
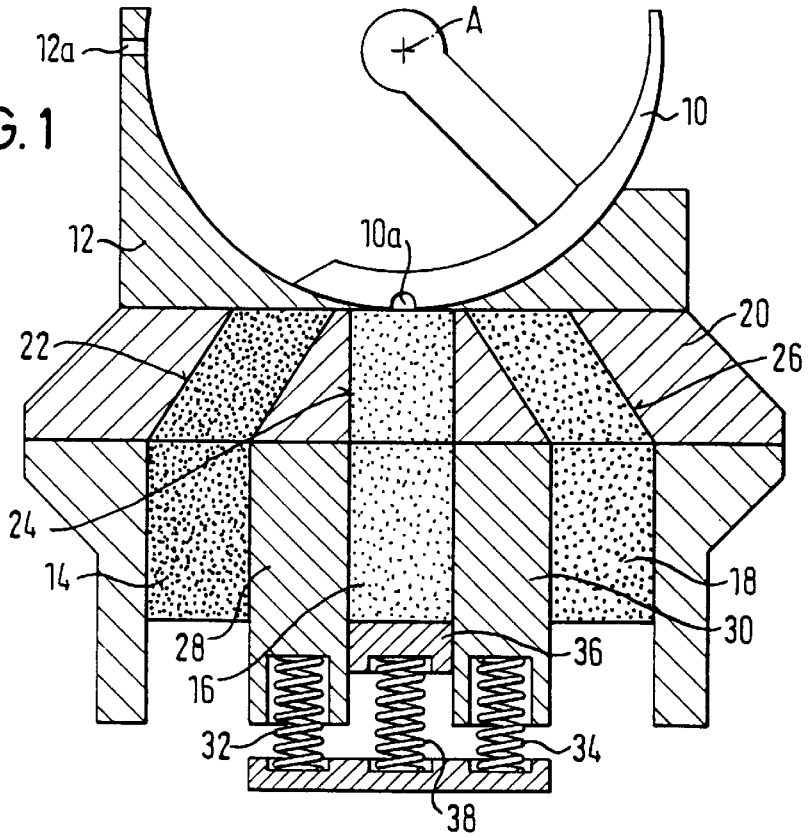
FIGS. 1, 2 and 3 are schematic diagrams showing the device in accordance with the invention in three different positions.
Figure 2:
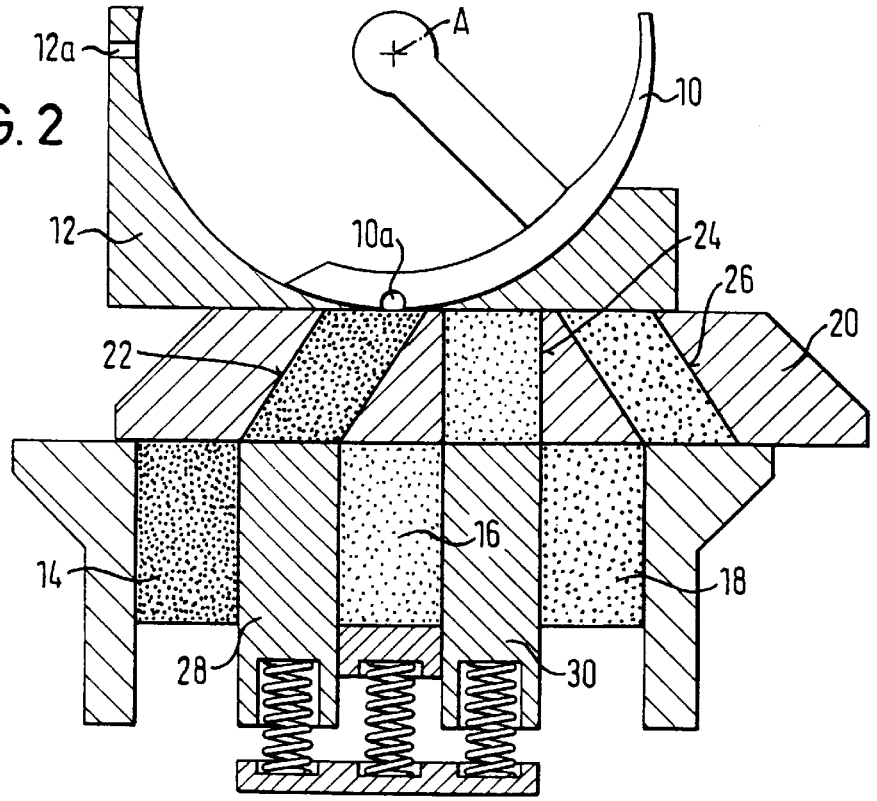
Figure 3:
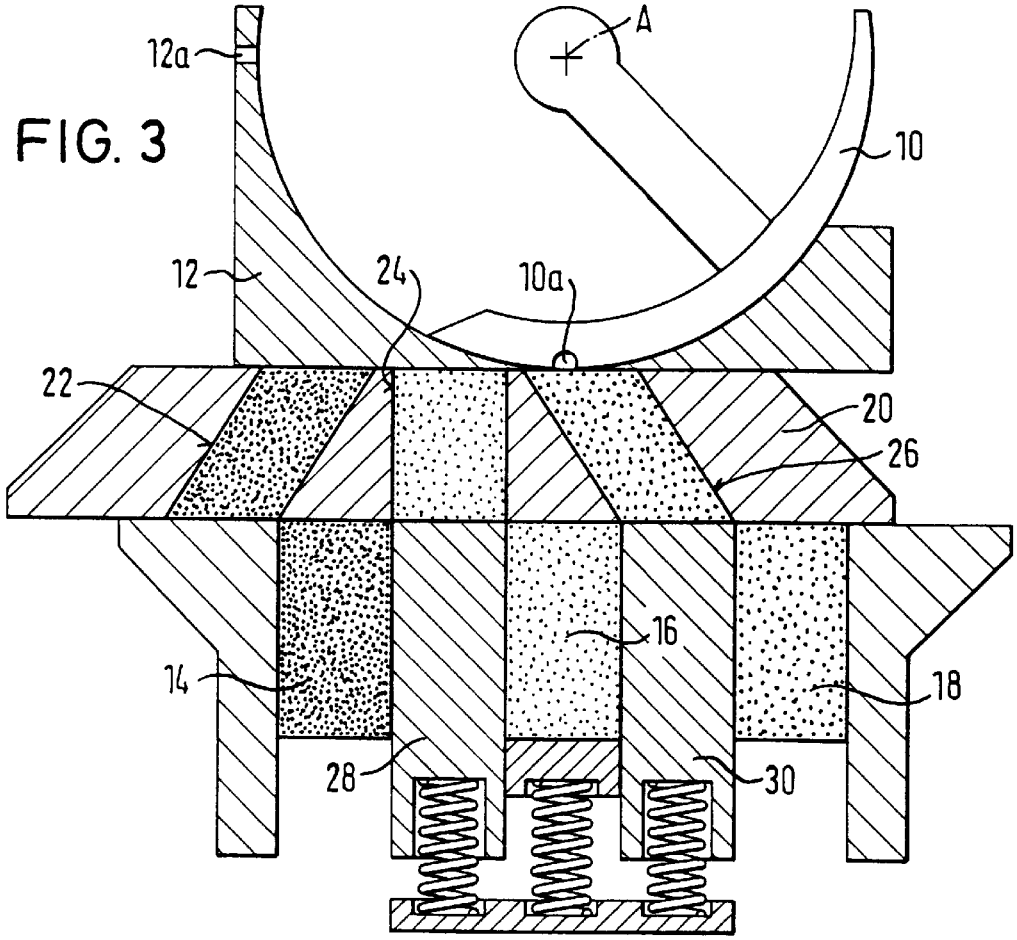

The device as shown in FIGS. 1 to 3 for removing individual tufts of fibers comprises conventionally a tuft remover 10 and a matching counterpart 12. The tuft remover 10 is, in this case, configured in the shape of a circular arc, the counterpart 12 being correspondingly curved; it is, however, also possible to configure the tuft remover and the counterpart straight. In all, three fiber bins 14, 16, 18 are provided which are filled with different kinds of fibers, more particularly, fibers differing in color. Arranged between the fiber bins 14, 16, 18 and the counterpart 12 is a slide 20 adapted to be shifted translationally horizontally. This slide 20 is provided with three through-passages 22, 24, 26. Each of these three through-passages 22, 24, 26 is firmly assigned to one of the fiber bins 14, 16, 18 and are in the starting position as shown in FIG. 1 directly above the assigned fiber bin. The two outer through-passages 22, 26 are inclined towards the central through-passage 24. The angle of inclination of the outer through-passages 22, 26 is so selected that the ends of these through-passages are mutually offset horizontally by a degree corresponding to the spacing between the associated fiber bin 14 or 18 and the central fiber bin 16. Between the outer fiber bins 14, 18 and the central fiber bin 16 one ram 28, 30 each is arranged. Each of the rams 28, 30 is urged by a compression spring 32, 34.

In the starting position as shown in FIG. 1 the free end faces of the rams 28, 30 are supported by the side surface area of the slide 20 facing them. The inlet of the fiber bin 16 is closed off by a further ram 36 urged by a compression spring 38 against the filling of the fiber bin 16. In the same way the inlets of the fiber bins 14 and 18 are closed off by rams (not shown).

In the starting position of the device as shown in FIG. 1 the slide 20 is in a central position in which the through-passage 24 directly adjoins the upper end of the fiber bin 16 and is positioned opposite to the tuft remover 10. The latter is provided with a notch 10*a* which in known ways and means removes a tuft of fibers (or bristles) from the upper end of the through-passage 24 whilst the tuft remover 10 in the shape of a circular arc is pivoted about the axis A. The tuft received in the notch 10*a* is transported by further pivoting of the tuft remover 10 to a transfer port 12*a* where it is taken over by a stuffing tool.

In this position of the device each of the outer through-passages 22, 26 directly adjoins by its lower end the upper end of the corresponding fiber bin 14 and 18, respectively, and each is closed off at its upper end by the opposite surface area of the counterpart 12. In this position the through-passages 22, 26 are filled from below with fibers from the associated fiber bin 14 and 18, respectively, arranged below.

In the position of the device as shown in FIG. 2 the slide 20 is shifted horizontally to such a degree that the through-passage 22 is located with its upper end opposite to the tuft remover 10 whilst the lower end of the through-passage 22 adjoins the end face of the ram 28 which applies pressure to it. Each of the through-passages 24 and 26 is closed off at its upper end by the opposite surface area of the counterpart 12; the lower end of the through-passage 24 is closed off by the upper end face of the ram 30, and the lower end of the through-passage 26 is closed off by the wall laterally defining the fiber bin 18 and guiding the slide 20. It will be appreciated that in the transfer from the position as shown in FIG. 1 to the position as shown in FIG. 2 there is no clashing between the fiber bins 14, 16, 18 and non-assigned through-passages 22, 24 or 26, i.e. the different kinds of fibers remain radically separated.

In the position as shown in FIG. 3 the slide 20 is shifted horizontally to such a degree that now the upper end of the through-passage 26 has been brought into the opposite position relative to the tuft remover 10. The lower end of this through-passage 26 is closed off by the upper end face of the ram 30 and is urged with pressure by the latter. Analogous to the condition as shown in FIG. 2 the through-passages 22 and 24 are each closed off at the upper and lower ends. In this position, too, no intermingling of fibers of one of the fiber bins 14, 16, 18 with fibers from non-assigned through-passages 22, 24, 26 occurs.

Figure 4:
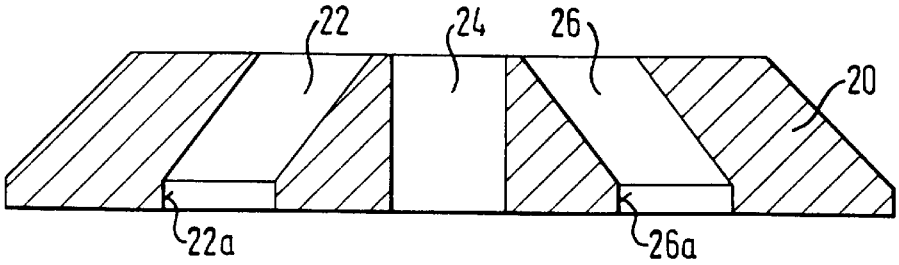
FIGS. 4 and 5 are schematic diagrams of two variants.

In the variant of the slide 20 as shown in FIG. 4 each of the outer through-passages 22, 26 comprises at its lower end a short section 22*a* and 26*a*, respectively, which is parallel to the central through-passage 24. This configuration of the outer through-passages 22, 26 facilitates transfer of fibers from the fiber bin 14 or 18 located therebelow.

Figure 5:
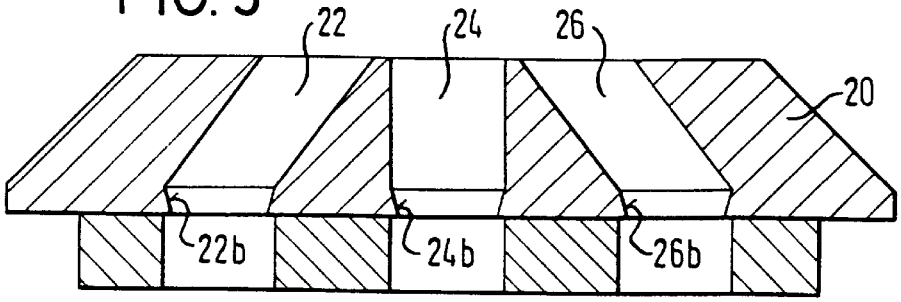

In the variant of the slide 20 as shown in FIG. 5 the lower end of each through-passage 22, 24, 26 is provided with a bottleneck 22*b*, 24*b* and 26*b*, respectively. Due to this bottleneck the fibers are held together radially at the lower end of each through-passage to enhance smooth sliding of the slide 20 along the parting plane between slide and fiber bins.

Figure 6:
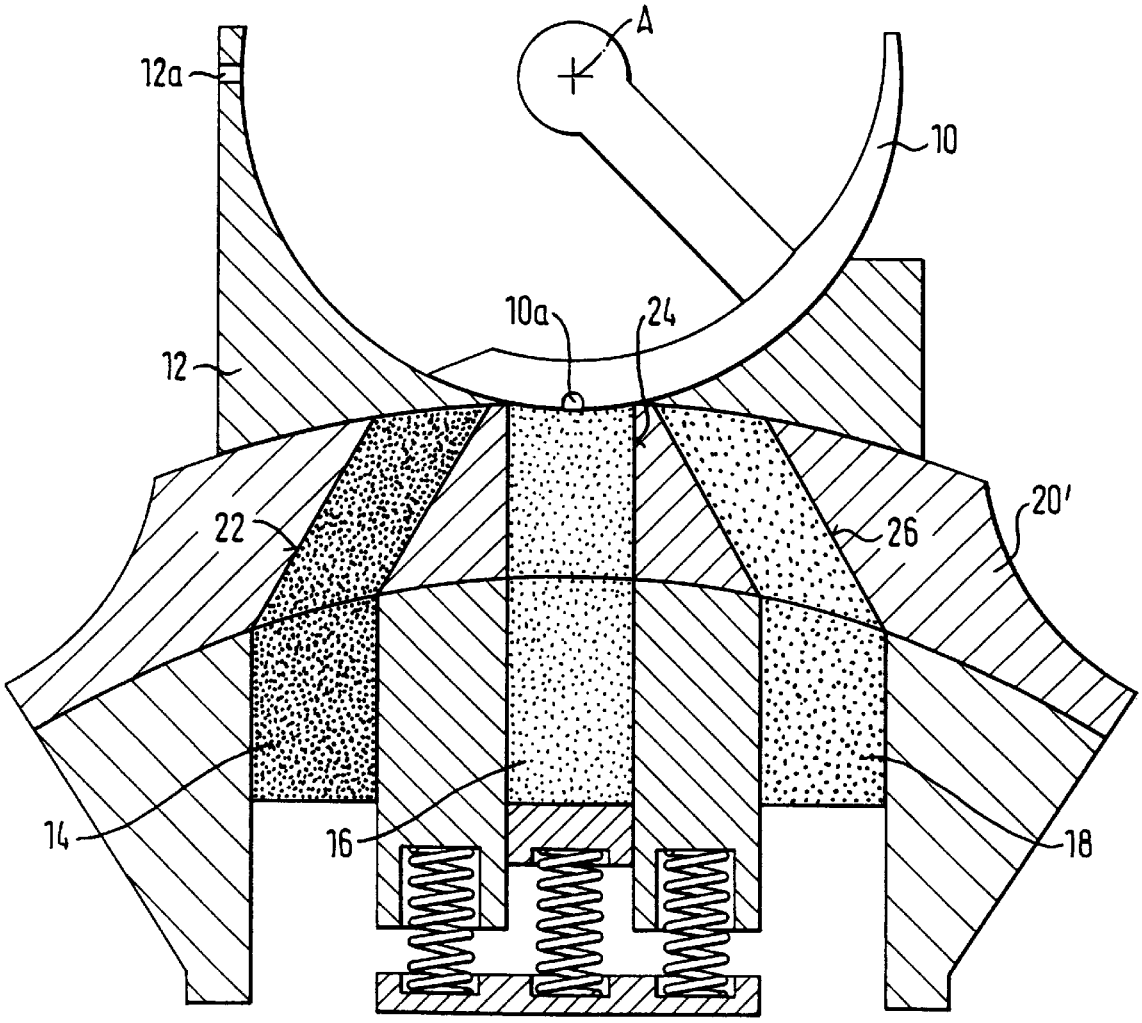
FIG. 6 is a schematic diagram of a variant having a slide in the shape of a circular arc.

In the variant as shown in FIG. 6 the slide 20' is designed in the shape of a circular arc instead of straight. The movement of the slide occurs likewise in the shape of a circular arc instead of straight as in the FIGS. 1 to 5. Apart from this, the acting principle is totally the same as that of the variants having a straight slide.

It will readily be appreciated that others variants are just as possible; for example, instead of three fiber bins, four, five or more fiber bins and passages may be provided.

What is claimed is:

1. A device for removing individual fiber tufts from a plurality of fiber bins of a brush making machine, said fiber bins comprising a central bin and at least two outer bins, the device comprising a tuft remover;

a counterpart matching said tuft remover;

a movable slide arranged between said counterpart and said fiber bins; wherein a) said slide has a plurality of through-passages each of which is consistently associated with one of said fiber bins, said through-passages comprising a central through-passage and at least two outer through-passages;

b) said outer through-passages of said slide are inclined at an angle to said central through-passage; and c) a ram is arranged between said central bin and each of said outer bins, each ram having an end face facing said slide and either bearing on one side surface area of said slide or applying pressure to an opposite end of one of said outer through-passages, depending on whether said slide presents to said ram end face an end of an outer through-passage or a surface area on said slide between an outer through-passage and said central through-passage.

2. The device as set forth in claim 1, wherein three fiber bins and three through-passages are provided.

3. The device as set forth in claim 1, wherein said outer through-passages have ends offset in a direction of movement of said slide by a degree corresponding substantially to a width of an adjacent ram measured in the same direction.

4. The device as set forth in claim 1, wherein said slide is movable translationally.

5. The device as set forth in claim 1, wherein said slide is movable along a path in the shape of a circular arc.

6. The device as set forth in claim 1, wherein said outer through-passages comprise at their end adjoining said fiber bins a short section parallel to said central through-passage.

7. The device as set forth in claim 1, wherein at least each of said outer through-passages has a bottleneck at an end adjoining said fiber bins.

8. The device as set forth in claim 1, wherein said fiber bins are arranged below said tuft remover.

9. The device as set forth in claim 1, wherein said tuft remover is configured in the shape of a circular arc and said counterpart is matching curved.

* * * * *